US010409193B2

(12) United States Patent
Hirata

(10) Patent No.: US 10,409,193 B2
(45) Date of Patent: Sep. 10, 2019

(54) WASTE DEVELOPER CONTAINER AND IMAGE FORMING DEVICE INCLUDING THE SAME

(71) Applicant: KONICA MINOLTA, INC., Chiyoda-ku, Tokyo (JP)

(72) Inventor: Daiki Hirata, Okazaki (JP)

(73) Assignee: KONICA MINOLTA, INC., Tokyo (JP)

( * ) Notice: Subject to any disclaimer, the term of this patent is extended or adjusted under 35 U.S.C. 154(b) by 163 days.

(21) Appl. No.: 15/586,768

(22) Filed: May 4, 2017

(65) Prior Publication Data

US 2017/0329255 A1 Nov. 16, 2017

(30) Foreign Application Priority Data

May 10, 2016 (JP) ..... 2016-094843

(51) Int. Cl.
*G03G 15/08* (2006.01)
*G03G 21/12* (2006.01)

(52) U.S. Cl.
CPC ..... *G03G 15/0856* (2013.01); *G03G 21/12* (2013.01)

(58) Field of Classification Search
None
See application file for complete search history.

(56) References Cited

U.S. PATENT DOCUMENTS 4,849,791 A * 7/1989 Hagihara ..... G03G 21/12 399/360
5,530,530 A * 6/1996 Tanaka ..... G03G 15/0893 399/30
2010/0021212 A1* 1/2010 Sumii ..... G03G 15/0844 399/262

FOREIGN PATENT DOCUMENTS

JP H10221943 A 8/1998
JP 2010072310 A 4/2010
JP 2012155279 A 8/2012

* cited by examiner

*Primary Examiner* — Roy Y Yi
(74) *Attorney, Agent, or Firm* — Cantor Colburn LLP

(57) ABSTRACT

Provided is a waste developer container to be fixed to an image forming device including a developing device and a waste developer amount detection unit for obtaining information on an amount of accumulated waste developer discharged from the developing device, wherein the developing device uses toner image carrier holding a toner image and two-component developer to form a toner image, the waste developer amount detection unit obtains the information on the accumulated amount by emission and reception of light, and the waste developer container includes: a container space for containing waste developer discharged; a detection window for passing light that is emitted from the waste developer amount detection unit, passes the container space, and is incident again to the waste developer amount detection unit; and a magnet provided to a position where a magnetic force is applied to the detection window and light passing the detection window is not shut.

13 Claims, 9 Drawing Sheets

WASTE DEVELOPER CONTAINER AND IMAGE FORMING DEVICE INCLUDING THE SAME

The present invention claims priority under 35 U.S.C § 119 to Japanese Patent Application No. 2016-094843 filed May 10, 2016 including description, claims, drawings, and abstract are incorporated herein by reference in its entirety.

BACKGROUND OF THE INVENTION

Field of the Invention

The present invention relates to an image forming device for forming a toner image with two-component developer and its waste developer container. In more detail, the present invention relates to a waste developer container that can detect the amount of contained waste developer and an image forming device including the same.

Description of the Related Art

In an image forming device that uses toner, waste toner is produced in connection with forming an image. Therefore, there is an image forming device including a waste toner container for containing produced waste toner. An example is the image forming device described in JP 2012-155279 A. That is, the collection container 101 disclosed in JP 2012-155279 A (see paragraph [0053] and FIGS. 2 and 3 of JP 2012-155279 A) corresponds to waste toner container.

However, in the technique described above, there has been the following problems. Of course, such a waste toner container will be full by forming an image. Therefore, it is necessary to detect that the waste toner container is full or almost full by some methods. This is to notify a user of necessity of maintenance such as change of the waste toner container. One method is optical detection. In optical detection, light passes in the waste toner container and full of the waste toner container is detected when light is shielded with the increase of waste toner.

In addition, recently, an image is developed by a trickle developing method in some image forming devices that use two-component developer (toner+carrier). In a trickle developing method, carrier is also supplied when toner is supplied to a developing device. The amount of the carrier in the developing device is kept at appropriate range by discharging developer including deteriorated carrier from the developing device. The trickle developing method is advantageous in keeping electric charging amount of the toner against durable use constant and keeping image quality high.

In such an image forming device, not only waste toner but also waste developer is produced. Therefore, a waste developer container is necessary and detection of full of the waste developer container is also necessary. Then, although the use of optical detection is considered as described above, it is not as successful for waste developer as in the case of waste toner. The reason is that the waste developer contained in the waste developer container is floating and adheres to an inner wall surface of the container. Therefore, since light for detecting full is shielded, full is detected much earlier than actual full. Although it does not mean that there is no such a phenomenon for waste toner, this problem is apparent for waste developer due to difference in charging characteristic and light shielding property between toner and carrier.

SUMMARY OF THE INVENTION

The present invention has been developed to solve the problems described above. That is, an object of the present invention is to provide an image forming device that successfully detects the amount contained in a waste developer container while developing an image by a trickle developing method with two-component developer. In addition, another object of the present invention is to provide a waste developer container suitable for such an image forming device.

To achieve at least one of the abovementioned objects, according to an aspect, a waste developer container reflecting one aspect of the present invention is to be fixed to an image forming device including a developing device and a waste developer amount detection unit for obtaining information on an amount of accumulated waste developer discharged from the developing device, wherein the developing device is a developing device that uses toner image carrier holding a toner image and two-component developer including toner and carrier to form a toner image held on the toner image carrier by a trickle developing method, the waste developer amount detection unit obtains the information on the accumulated amount by emission and reception of light, and the waste developer container comprises: a container space for containing waste developer discharged from the developing device; a detection window for passing light that is emitted from the waste developer amount detection unit, passes the container space, and is incident again to the waste developer amount detection unit; and a magnet provided to a position where a magnetic force is applied to the detection window and light passing the detection window is not shut.

In the waste developer container according to the aspect, light emitted from a waste developer amount detection unit of an image forming device is incident to a waste developer amount detection unit again without being shielded by waste developer in a container space when the amount of waste developer contained in the container space is little. However, as the amount of contained waste developer increases, light emitted from the waste developer amount detection unit is shielded by waste developer in the container space. Accordingly, the light is not incident again in the waste developer amount detection unit. Such a change in existence of reincidence can be treated as information regarding the amount of accumulation of waste developer discharged from the developing device in the image forming device. Here, in the aspect described above, magnetic force of magnet is applied to a detection window. Therefore, even if part of waste developer is floating in the container space, carrier in the floating developer is attracted by the magnet near the detection window. Therefore, carrier in the waste developer is prevented from adhering to an inner surface of the detection window. Accordingly, the amount of accumulation of waste developer is successfully detected by the waste developer amount detection unit without being affected by adherence of the carrier to the detection window.

In the waste developer container according to the aspect, the magnet preferably faces the container space. This is because that floating carrier can be attracted by the magnet more certainly.

In the waste developer container according to the aspect, the magnet is preferably provided at a position that is upper in a direction of a gravitational force than the location where light that is incident from the waste developer amount detection unit in the detection window and light emitted to the waste developer amount detection unit pass. With the configuration described above, the magnet will not be covered by waste developer until the light is shielded by contained but not floating waste developer. Therefore, absorption characteristic of floating carrier by magnet can be maintained until the actual amount of accumulation of waste developer is detected.

In the waste developer container according to the aspect, the waste developer container preferably further comprises a carrying member for carrying waste developer contained in the container space in the container space, wherein the magnet is preferably provided to a position that is upper than the carrying member in a direction of a gravitational force. This carrying member prevents waste developer from concentrating on the specific area in the container space and is useful for effectively using the capacity of the container space. In contrast, waste developer can be scattered to float. By arranging the magnet in such a way, it is possible to effectively attract the carrier scattered by the carrying member.

In the waste developer container according to the aspect, the waste developer container preferably further comprises a partition wall for dividing the container space into a waste developer container space for containing waste developer discharged from the developing device and a waste toner container space for containing waste toner collected from the toner image carrier, wherein the carrying member is preferably provided in the waste developer container space, and the detection window is preferably a part of an outer wall that separates the waste developer container space from outside. Generally, in an image forming device using two-component developer, waste toner is produced as well as waste developer. With the configuration described above, the amount of accumulation of waste developer including carrier can be successfully detected as described above while waste toner and waste developer are contained in different container spaces.

In the waste developer container according to the aspect, the detection window is preferably made of polystyrene or synthetic resin that is on a minus charging side on a triboelectric series with respect to polystyrene. With such a configuration, charging of the carrier and static electricity of the detection window are likely to be reverse polarity. Therefore, floating carrier easily adheres to the detection window. Accordingly, the significance of removing floating carrier by magnet is large.

To achieve at least one of the abovementioned objects, according to an aspect, an image forming device reflecting one aspect of the present invention comprises: a toner image carrier for holding a toner image; a developing device that uses two-component developer including toner and carrier to forma toner image held on the toner image carrier by a trickle developing method; a waste developer container including a container space for containing waste developer discharged from the developing device; a waste developer amount detection unit provided outside the waste developer container for obtaining information on an amount of waste developer contained in the waste developer container by receiving light that is emitted to the waste developer container, passes the container space, and is emitted from the waste developer container; a detection window provided as a part of the waste developer container for passing the light between the waste developer amount detection unit and the container space; and a magnet provided to a position where a magnetic force is applied to the detection window and light passing the detection window is not shut.

In the image forming device according to the aspect, the developing device preferably develops an image with an amount of charging of the carrier being a range between 40 and 60 μC/g. The large amount of charging of carrier in a developing device means that the amount of charging of carrier discharged as waste developer is also large. Since this means that floating carrier easily adheres to the detection window, the significance of removing floating carrier by magnet is large.

In the image forming device according to the aspect, the magnet preferably faces the container space.

In the image forming device according to the aspect, the magnet is preferably provided at a position that is upper in a direction of a gravitational force than the location where light that is incident from the waste developer amount detection unit in the detection window and light emitted to the waste developer amount detection unit pass.

In the image forming device according to the aspect, the image forming device preferably further comprises a carrying member for carrying waste developer contained in the container space in the container space, wherein the magnet is preferably provided to a position that is upper than the carrying member in a direction of a gravitational force.

In the image forming device according to the aspect, the image forming device preferably further comprises a partition wall for dividing the container space into a waste developer container space for containing waste developer discharged from the developing device and a waste toner container space for containing waste toner collected from the toner image carrier, wherein the carrying member is preferably provided in the waste developer container space, and the detection window is preferably a part of an outer wall that separates the waste developer container space from outside.

In the image forming device according to the aspect, the detection window is preferably made of polystyrene or synthetic resin that is on a minus charging side on a triboelectric series with respect to polystyrene.

BRIEF DESCRIPTION OF THE DRAWINGS

The above and other objects, advantages and features of the present invention will become more fully understood from the detailed description given hereinbelow and the appended drawings which are given byway of illustration only, and thus are not intended as a definition of the limits of the present invention, and wherein.

DESCRIPTION OF THE PREFERRED EMBODIMENTS

Figure 1:
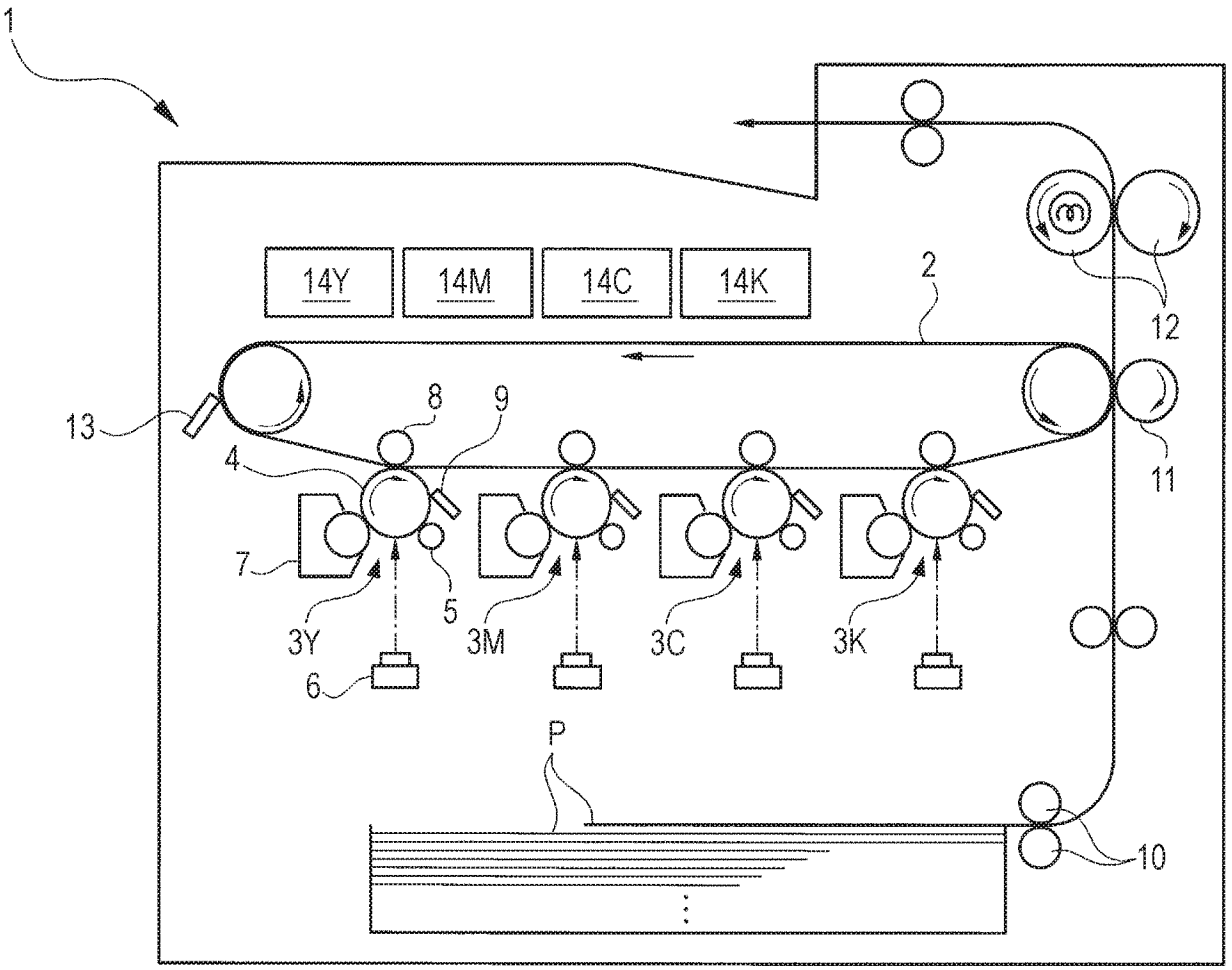
FIG. 1 is a cross-sectional view illustrating a schematic configuration of an image forming device according to an embodiment.

Hereinafter, an embodiment of the present invention will be described in detail with reference to the drawings. However, the scope of the invention is not limited to the illustrated examples. In the embodiment of the present invention, the present invention is applied to an image forming device 1 illustrated in FIG. 1. The image forming device 1 illustrated in FIG. 1 includes an intermediate transfer belt 2 and four image forming units 3Y to 3K provided under the intermediate transfer belt 2. Hereinafter, the image forming units 3Y to 3K are simply referred to as image forming unit 3 in some cases without distinguishing by the color symbols Y to K.

Each image forming unit 3 has a photoreceptor 4 in the center thereof. A charging unit 5, an exposure head 6, a developing device 7, a primary transfer roller 8, and a photoreceptor cleaner 9 are provided around the photoreceptor 4. The primary transfer roller 8 is provided opposite to the photoreceptor 4 with the intermediate transfer belt 2 provided therebetween. Accordingly, a toner image is formed on the photoreceptor 4 by the developing device 7 and the toner image is transferred to the intermediate transfer belt 2.

The image forming device 1 further includes a paper feeding unit 10, a secondary transfer roller 11, and a fixing device 12. The toner image is transferred from the intermediate transfer belt 2 to paper P supplied from the paper feeding unit 10 and the toner image is fixed on the paper. Moreover, a belt cleaner 13 is provided in contact with the intermediate transfer belt 2. Furthermore, supplement developer bottles 14Y to 14K (hereinafter, simply referred to as "supplement developer bottle 14" in some cases) are detachably provided to the image forming device 1.

The developing device 7 according to the embodiment of the present invention develops an image with two-component developer including toner and carrier. Moreover, the developing device 7 according to the embodiment of the present invention develops an image by a trickle developing method. That is, not only the amount of toner in the developing device 7 is reduced by development but also the developing device 7 discharges the developer contained therein to some extent in order to prevent deterioration. Therefore, not only toner but also carrier is supplied from the supplement developer bottle 14 to the developing device 7. Since trickle developing method itself is a known method, detailed description thereof will be omitted. In addition, the developing device 7 according to the embodiment of the present invention develops an image with carrier charged at the charging amount ranging from 40 to 60 μC/g. This charging amount is bit higher than the charging amount in a known and popular two-component developing device.

Figure 2:
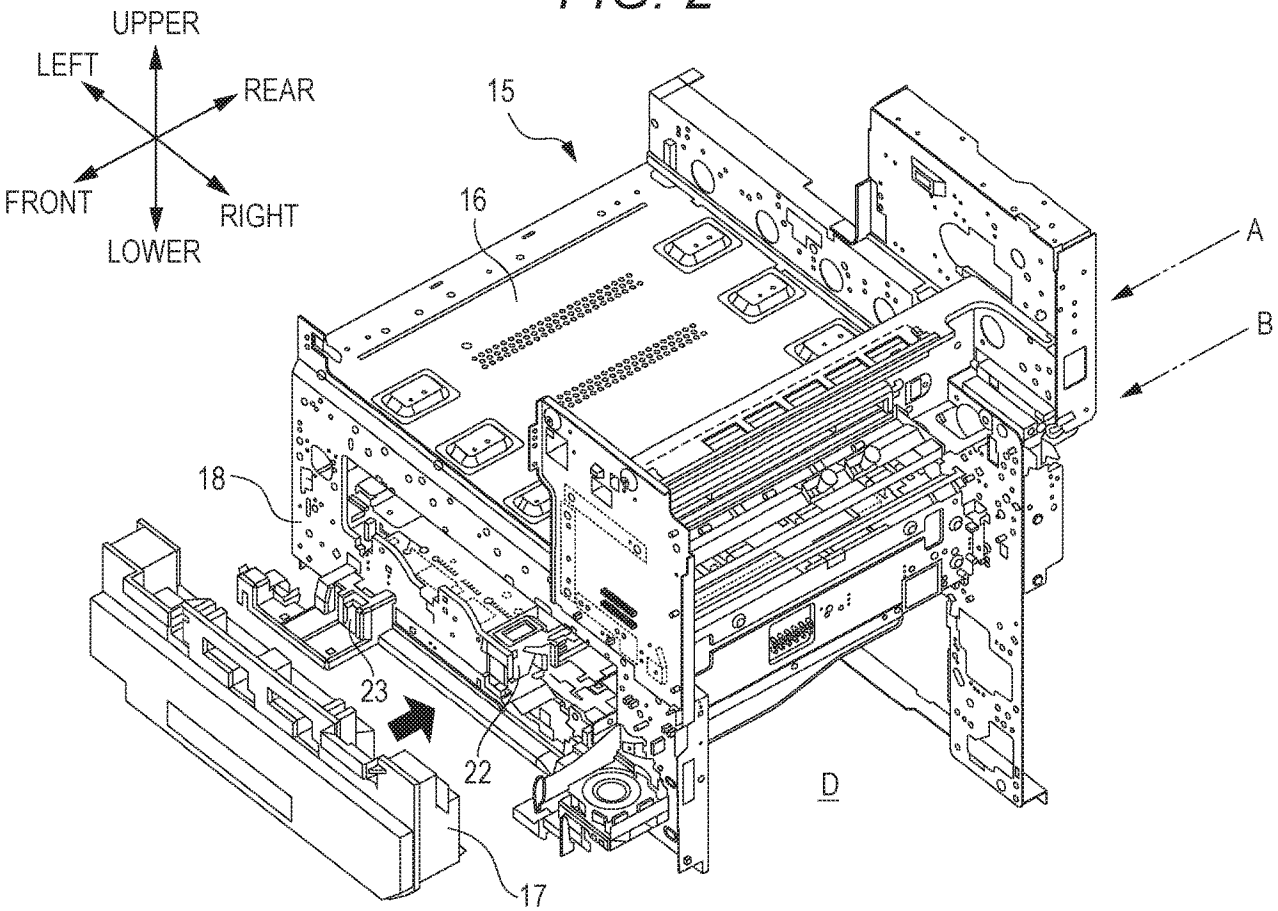
FIG. 2 is a perspective view illustrating a chassis inside the image forming device according to the embodiment together with a waste developer container.

FIG. 2 is a perspective view illustrating a chassis (frame) 15 inside the image forming device 1 according to the embodiment of the present invention. Various inner devices of the image forming device 1 illustrated in FIG. 1 are fixed to various parts in the chassis 15. For example, the fixing device 12 is located near the axis shown by an arrow A, and the secondary transfer roller 11 is located near the axis shown by an arrow B. In addition, the paper feeding unit 10 is located near the symbol D that is the lower part in the chassis 15. The intermediate transfer belt 2 is contained under an upper plate 16 of the chassis 15. The supplement developer bottles 14Y to 14K are located in a space at the upper side of the upper plate 16.

Then, the image forming device 1 according to the embodiment of the present invention includes a waste developer container 17 illustrated in FIG. 2. The waste developer container 17 is a container for containing waste developer and waste toner produced by execution of image forming by the image forming device 1. In the image forming device 1 that is operating, the waste developer container 17 is fixed to the front of a front plate 18 of the chassis 15. The waste developer container 17 can be attached and detached, and is exchanged when it is full of waste developer or waste toner.

Figure 3:
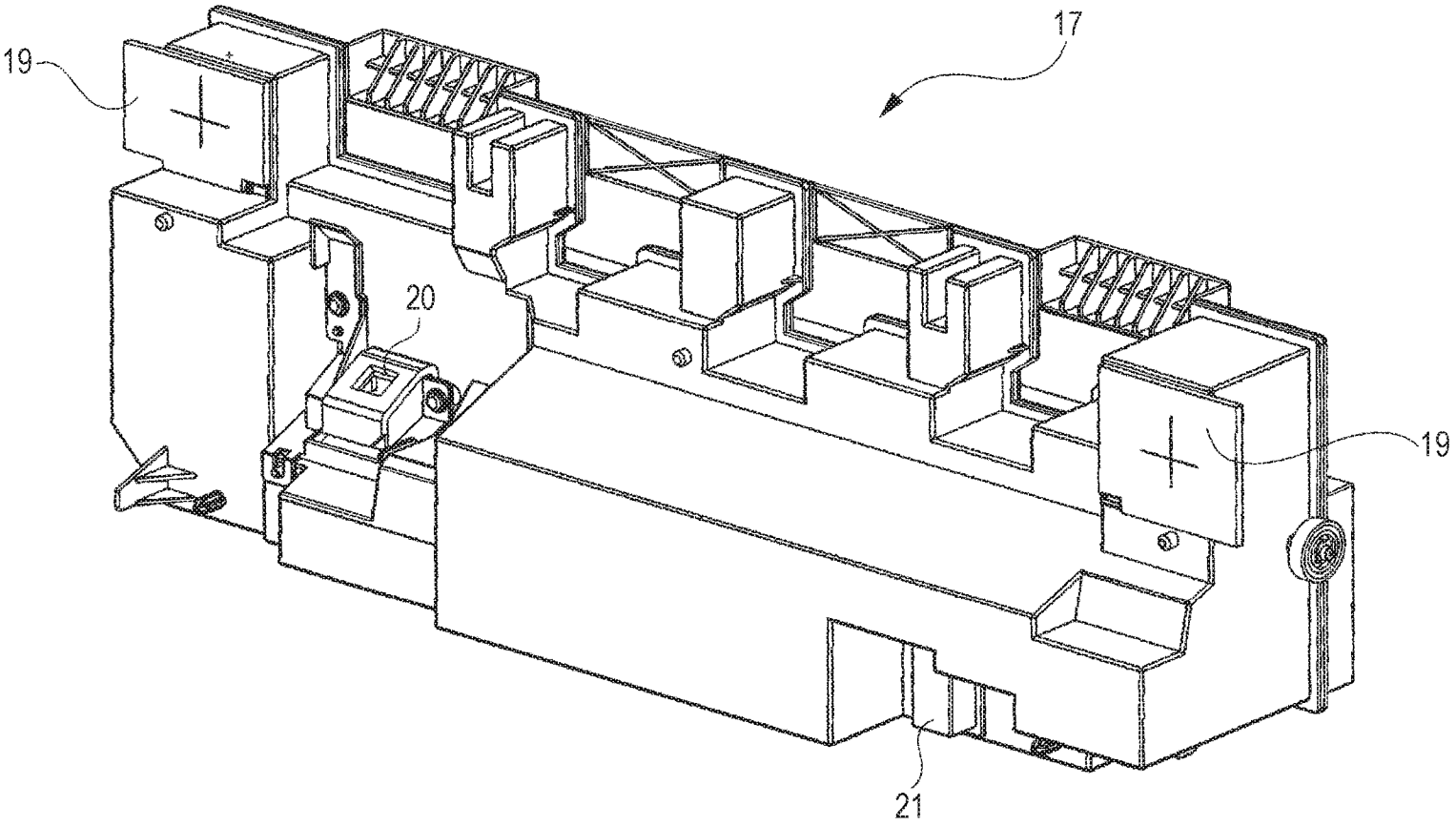
FIG. 3 is a perspective view illustrating the waste developer container according to the embodiment viewer from the rear side.

FIG. 3 is a perspective view illustrating the waste developer container 17. In FIG. 3, the waste developer container 17 is viewed from the rear side unlike FIG. 2. That is, the front side of the waste developer container 17 in FIG. 3 is the side that faces the front plate 18 of the chassis 15 when it is fixed to the image forming device 1. Cross-cut parts 19 are provided at both ends at the upper part of the waste developer container 17 in FIG. 3. This part is made of a flexible rubber film, and is a waste toner acceptance inlet for accepting the waste toner from the image forming device 1 in the waste developer container 17.

In addition, a waste developer acceptance inlet 20 is provided at the slightly left side with respect to the center in the right and left direction and the lower side with respect to the cross-cut part 19. The waste developer acceptance inlet 20 is an opening that opens upward for accepting the waste developer from the image forming device 1 in the waste developer container 17. The waste developer acceptance inlet 20 in FIG. 3 opens obliquely upward. In addition, a projection part 21 is provided at the slightly right side with respect to the center in the right and left direction and the lower side with respect to the waste developer acceptance inlet 20. As described later, the projection part 21 functions as a detection window for detecting the amount of contained waste developer on the main unit side of the image forming device 1.

Referring back to FIG. 2, a waste developer discharge unit 22 and a waste developer amount detection unit 23 are provided in the front of the chassis 15. The waste developer discharge unit 22 is a part that discharges waste developer produced by execution of image forming by the image forming device 1. That is, waste developer discharged from the developing devices 7 of each of image forming units 3Y to 3K is collected and discharged from the waste developer discharge unit 22. The waste developer amount detection unit 23 is a part that optically acquires information on the amount of waste developer contained in the waste developer container 17. Therefore, when the waste developer container 17 is fixed to the front face of the chassis 15, the waste developer discharge unit 22 faces the waste developer acceptance inlet 20 and the waste developer amount detection unit 23 faces the projection part 21.

Figure 4:
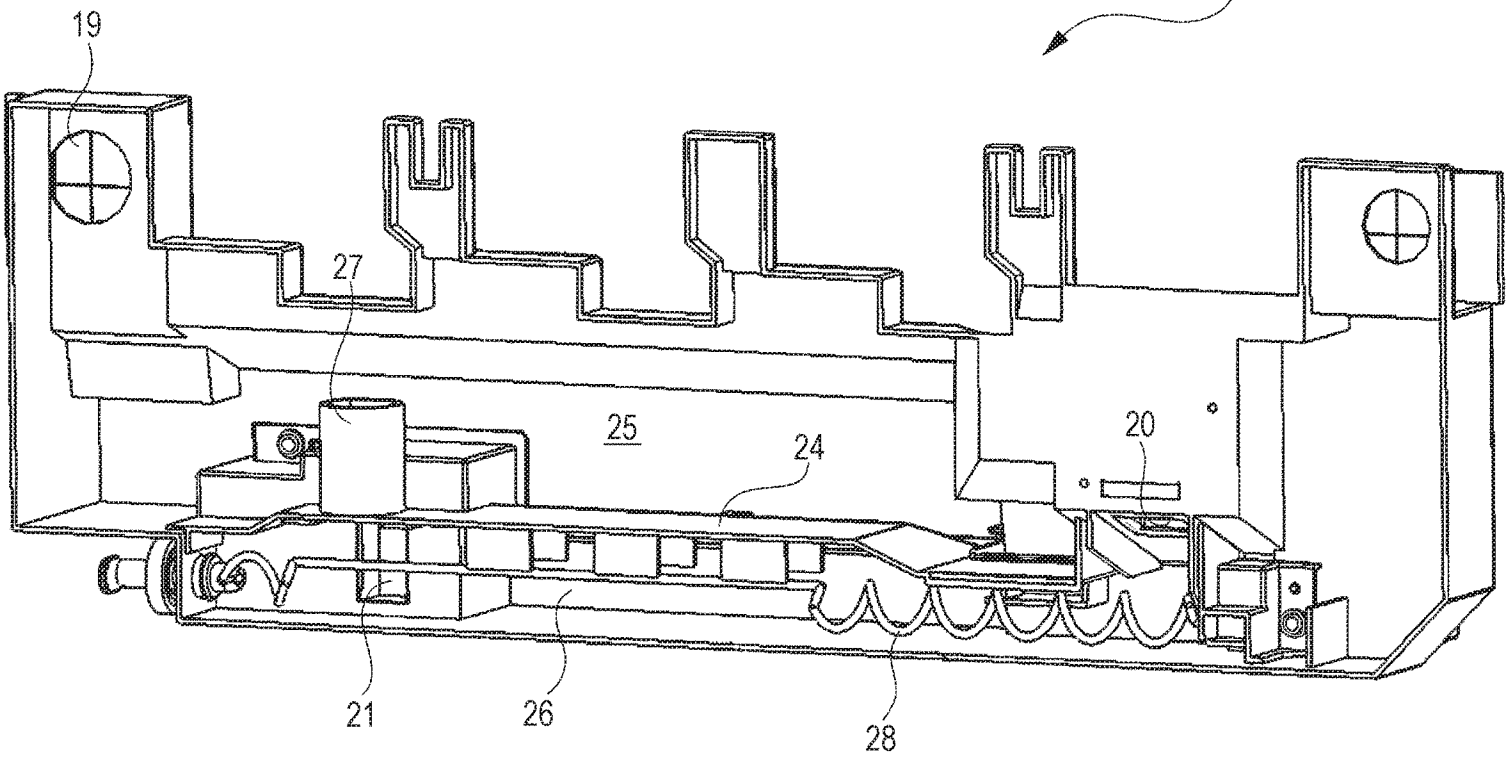
FIG. 4 is a first sectional perspective view illustrating an inner structure of the waste developer container according to the embodiment.

Next, the inner structure of the waste developer container 17 will be described. FIG. 4 is a perspective view illustrating an inner surface of a cut piece on the chassis 15 side when the waste developer container 17 is cut on the plane parallel to the front plate 18 of the chassis 15. That is, it is understood that FIG. 4 illustrates the shape of the back face of the front face of the waste developer container 17 in FIG. 3. Therefore, the cross-cut part 19 illustrated in FIG. 4 is the cross-cut part 19 of FIG. 3 viewed from the inner surface side. This is also true for the waste developer acceptance inlet 20 in FIG. 4. This is also true for the projection part 21, but the projection part 21 in FIG. 4 has of course concave shape. Note that, FIG. 4 is a drawing for explanation and the waste developer container 17 is not cut as illustrated in this drawing when it is actually used.

As illustrated in FIG. 4, a partition wall 24 is provided in the waste developer container 17. Accordingly, the inner space of the waste developer container 17 is divided into an upper chamber 25 and a lower chamber 26. The upper chamber 25 is connected to the cross-cut part 19. That is, the upper chamber 25 is a waste toner container space for containing waste toner. On the other hand, the lower chamber 26 is connected to the waste developer acceptance inlet 20. That is, the lower chamber 26 is a waste developer container space for containing waste developer. As described, waste toner and waste developer are contained in separate chambers in the waste developer container 17. However, a cylindrical part 27 projecting upward is provided to a part of the partition wall 24. The upper chamber 25 and the lower chamber 26 are connected in the cylindrical part 27. Therefore, when the depth of accumulation of the waste toner in the upper chamber 25 exceeds the projecting height of the cylindrical part 27, part of the waste toner in the upper chamber 25 spills down to the lower chamber 26. Note that, the projection part 21 described above is a part of an outer wall of the lower chamber 26 that projects outward.

A delivery screw 28 is provided in the lower chamber 26 of the waste developer container 17. The delivery screw 28 illustrated in FIG. 4 is obtained by forming a wire member in spiral shape. The delivery screw 28 is provided in the horizontal direction in the lower chamber 26. That is, the delivery screw 28 rotates to move the waste developer in the horizontal direction in the lower chamber 26. The reason why the delivery screw 28 is provided is that the lower chamber 26 is long and thin in the horizontal direction. The delivery screw 28 is provided so that the waste developer contained in the lower chamber 26 spreads over the lower chamber 26 without being kept at a location immediately under the waste developer acceptance inlet 20. Note that, the delivery screw 28 is rotationally driven by operation from the main unit side of the image forming device 1. In addition, of course, the delivery screw 28 is located lower than the partition wall 24.

Figure 5:
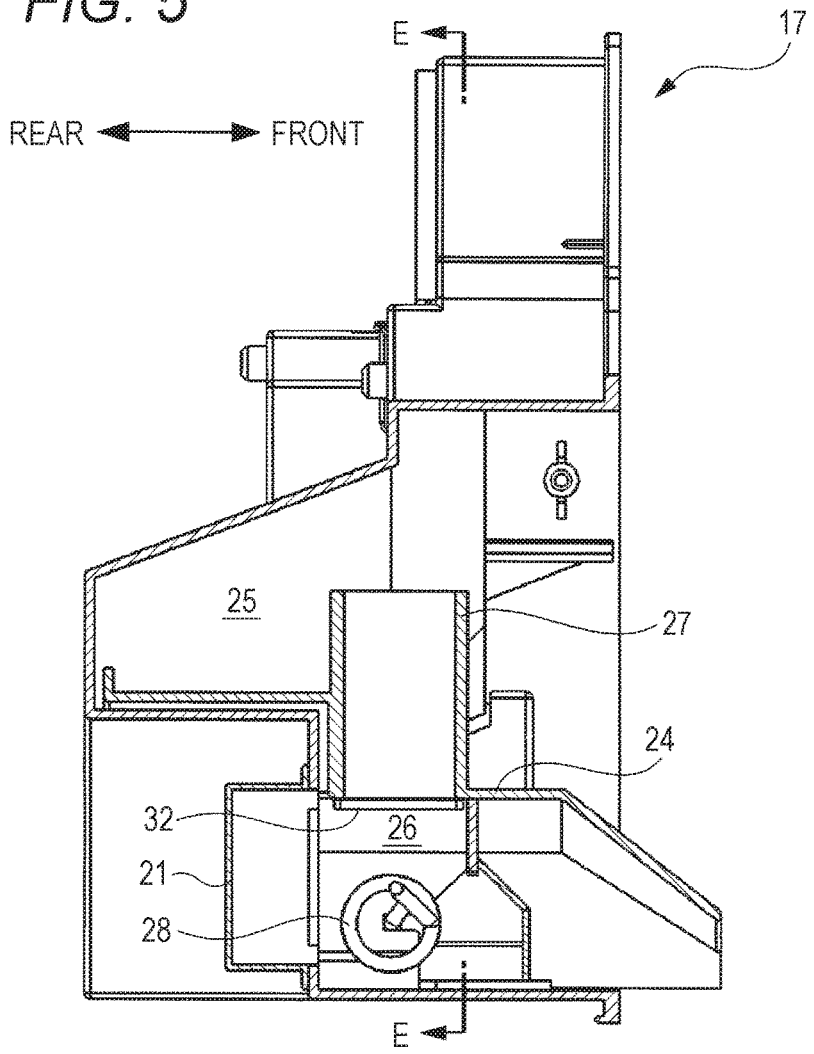
FIG. 5 is a side cross-sectional view illustrating the inner structure of the waste developer container according to the embodiment.

FIG. 5 is a side cross-sectional view illustrating the waste developer container 17. FIG. 5 is a cross-sectional view illustrating the waste developer container 17 that is cut on the vertical plane orthogonal to the front plate 18 of the chassis 15 at the position of the cylindrical part 27, and is a drawing viewing the right side from the left side in FIG. 2. The cut position in the sectional perspective view of FIG. 4 is the position of an arrow E in FIG. 5. Note that, the cross-cut part 19 and the waste developer acceptance inlet 20 described above are not shown on the cross-section of FIG. 5.

Figure 6:
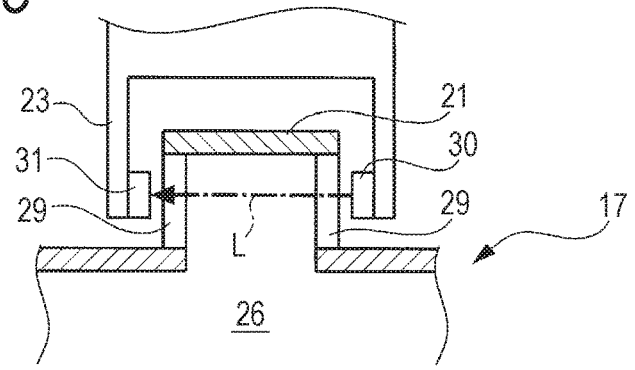
FIG. 6 is a plan cross-sectional view illustrating relationship of arrangement of a projection part of the waste developer container and a waste developer amount detection unit of a main unit.

Here, the projection part 21 of the waste developer container 17 and the waste developer amount detection unit 23 on the main unit side of the image forming device 1 will be described. For that purpose, FIG. 6 is a plan cross-sectional view illustrating the projection part 21. In FIG. 6, the projection part 21 is illustrated with the waste developer container 17 fixed to the chassis 15 (hereinafter referred to as "fixed state"). Therefore, in FIG. 6, the projection part 21 faces the waste developer amount detection unit 23. Note that, an inner space of the projection part 21 is connected to the lower chamber 26. Therefore, when the amount of waste developer contained in the lower chamber 26 increases, the waste developer enters the inner space of the projection part 21 as well.

As illustrated in FIG. 6, detection windows 29 are provided on both side faces of the projection part 21. The detection window 29 is a part of the wall surface of the projection part 21 and made from a transparent member. It is not opened. That is, the detection window 29 is a part of an outer wall that divides the lower chamber 26 from outside. On the other hand, a light emitting part 30 and a light receiving part 31 are provided to the waste developer amount detection unit 23. In the fixed state illustrated in FIG. 6, the detection windows 29 on the both side faces of the projection part 21 are between the light emitting part 30 and the light receiving part 31.

Therefore, when light L is emitted from the light emitting part 30, the light L penetrates the detection window 29, enters the inner space of the projection part 21, penetrates the detection window 29 again, and reaches the light receiving part 31. That is, the light L once penetrates the inner space of the projection part 21. The light L can be detected by the light receiving part 31 without problems when the amount of waste developer contained in the lower chamber 26 is little. However, as the amount of contained waste developer increases, the inner space of the projection part 21 will also be full of waste developer. In such a situation, the light L is shielded by the waste developer and cannot be detected by the light receiving part 31. The image forming device 1 can treat this situation as information that indicates that the lower chamber 26 is full of or almost full of waste developer. Accordingly, the image forming device 1 can display a notice to persuade the user to exchange the waste developer container 17 and take a measure for forcibly stopping image forming operation.

Figure 7:
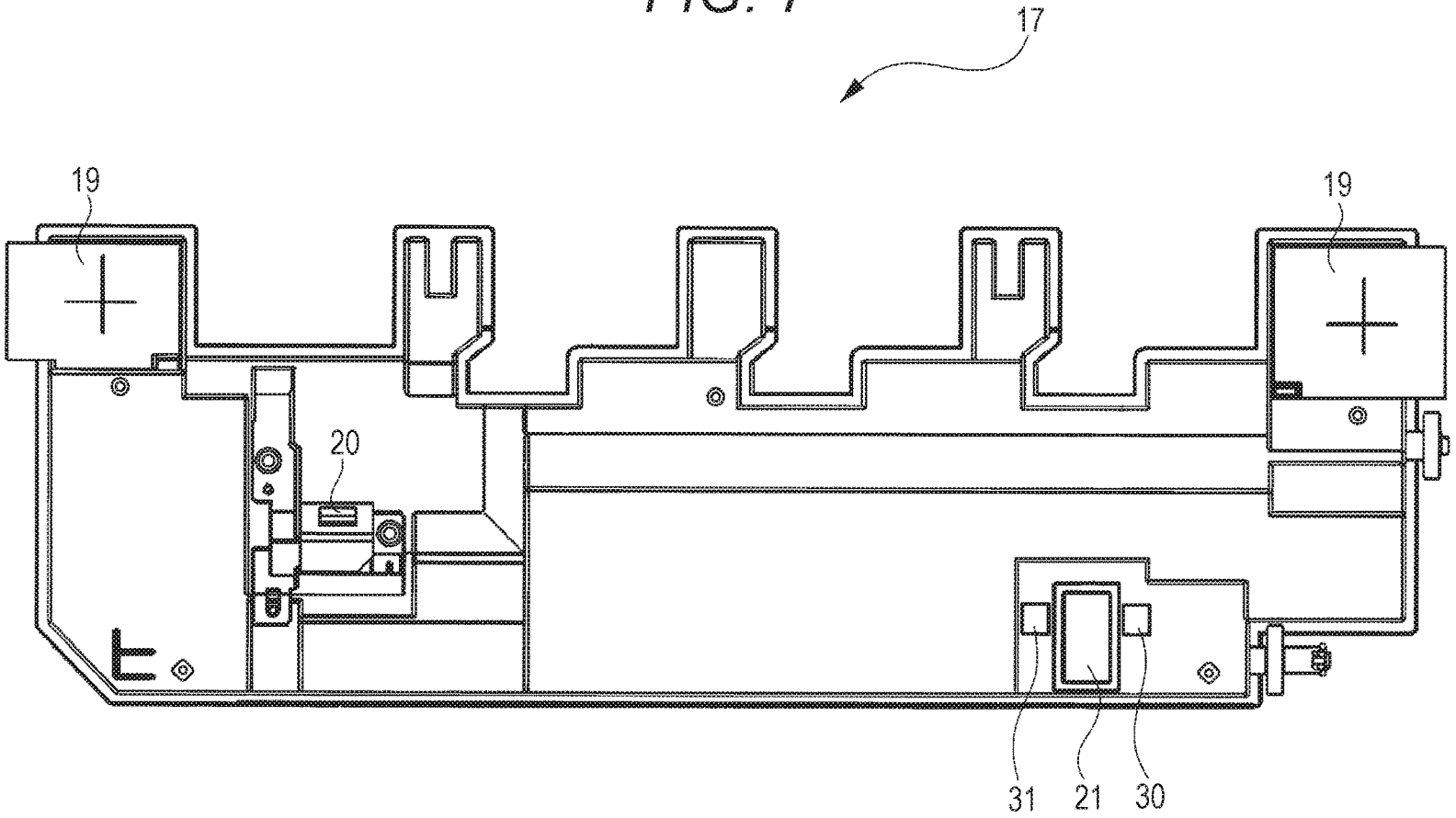
FIG. 7 is a rear view illustrating the waste developer container according to the embodiment.

Here, FIG. 7 is a rear view illustrating the waste developer container 17. In FIG. 7, the light emitting part 30 and the light receiving part 31 described above, which are parts on the main unit side, are also illustrated in addition to the waste developer container 17. From FIG. 7, it is understood that the light emitting part 30 and the light receiving part 31 are provided to relatively upper position in the height direction where the projection part 21 exists. This means that the height of the position of detection of the waste developer by the light emitting part 30 and the light receiving part 31 is very close to the lower face of the partition wall 24. That is, in the embodiment of the present invention, the waste developer amount detection unit 23 detects that the lower chamber 26 is almost full of the waste developer. Hereinafter, this is simply referred to as "full detection."

Figure 8:
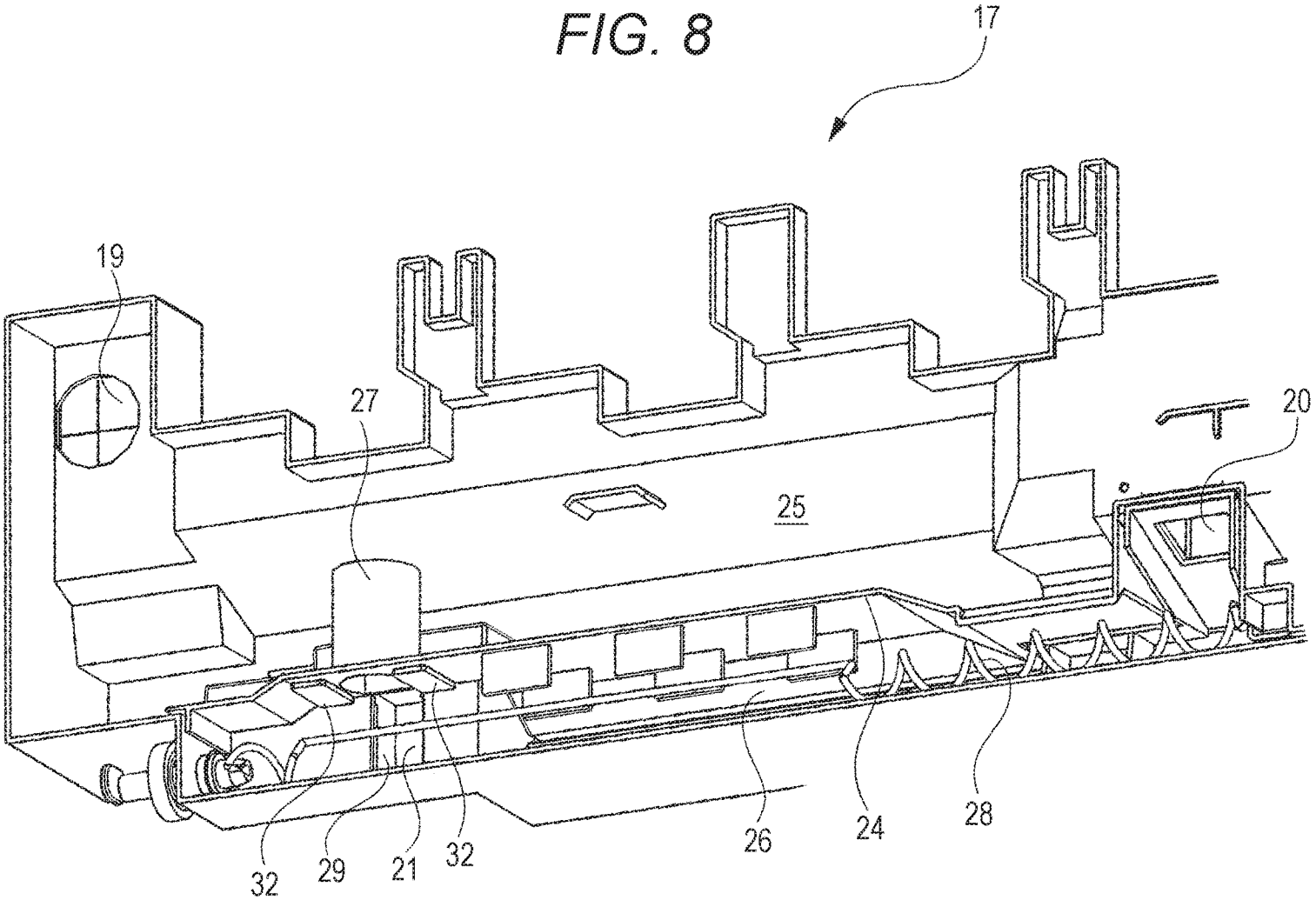
FIG. 8 is a second sectional perspective view illustrating the inner structure of the waste developer container according to the embodiment.

Here, the waste developer container 17 includes magnet near the detection window 29 of the projection part 21. This will be described with reference to FIG. 8. FIG. 8 is almost the same perspective view as FIG. 4, but viewing direction is slightly different. That is, in FIG. 8, the cut piece of the waste developer container 17 illustrated in FIG. 4 is illustrated as viewed obliquely upward from slightly lower position. As illustrated in FIG. 8, magnet 32 is fixed to the lower face of the partition wall 24. The magnet 32 is provided at both sides very close to the position where the projection part 21 is provided. Therefore, the magnet 32 is located near as viewed from the detection window 29 of the projection part 21. Therefore, magnetic force by the magnet 32 is applied to the position of the detection window 29. Note that, although the magnet 32 is illustrated also in FIG. 5, the side face, not the cross-section, of the magnet 32 is illustrated in FIG. 5. Therefore, the magnet 32 does not close the inner side of the cylindrical part 27. In addition, in FIG.

8, the magnet 32 is fixed near the cylindrical part 27. However, this is not mandatory.

The reason why the magnet 32 is provided is to prevent interruption of full detection of the lower chamber 26 by floating waste developer. This is because the waste developer contained in the lower chamber 26 tends to be charged by friction. Therefore, part of the waste developer may float in dust and fume form by electrostatic repulsion. The floating developer particle adheres to the wall surface of the lower chamber 26 by static electricity force in some cases. If such adhesion occurs to the inner surface of the detection window 29, full detection by the waste developer amount detection unit 23 is interrupted. Of course, the developer adhering to the inner surface of the detection window 29 shields the light L emitted from the light emitting part 30. Therefore, the light receiving part 31 cannot detect the light L even if the inner space of the projection part 21 is yet not full of developer, depending on the density of adhesion of the developer on the inner surface of the detection window 29. That is, full is detected much earlier than it is actually full. Therefore, the actual amount of content of the waste developer container 17 may not be fully used. This is a phenomenon of interruption of full detection by floating developer.

In the embodiment of the present invention, such interruption of full detection is prevented because of the magnet 32. This is because magnetic force by the magnet 32 is applied to the location of the detection window 29 and it vicinity as described above. On the other hand, carrier of the developer is iron powder. Therefore, carrier of the floating waste developer is attracted by the magnetic force of the magnet 32 and adheres to the surface of the magnet 32 near the detection window 29. The carrier adhering to the surface of the magnet 32 once hardly becomes floating state again. Therefore, near the detection window 29, even if floating developer exists, what is floating is toner and floating carrier is very few. Therefore, because there is no adhesion of floating carrier to the inner surface of the detection window 29, there is no interruption of full detection as described above. Therefore, it is possible to fully use the actual content of the waste developer container 17.

Note that, as is understood from the above description, what is attracted by the magnet 32 is only carrier that is iron powder. Resin toner is not attracted by the magnet 32. Therefore, theoretically, adhesion of floating toner to the detection window 29 occurs even if the magnet 32 is provided. However, this is not a big practical problem. This is because light shielding property of resin toner is lower than that of carrier that is iron powder. In addition, since toner is lighter than carrier, it tends to be largely affected by repulsion by charging of the same polarity of toner than carrier. Therefore, even if toner adheres to the inner surface of the detection window 29, the adhesion density is not so much increased than carrier. There is another reason, which will be described later.

Here, the position of the magnet 32 will be described. In the embodiment of the present invention, the position described above where the magnet 32 is provided is the position near the almost upper end of the lower chamber 26 that contains waste developer. That is, the position of the magnet 32 in the embodiment of the present invention is higher than the position of incidence/emission of the light L at the detection window 29. In addition, it is higher than the delivery screw 28.

The configuration described above provides following advantages. First, even if the amount of the waste developer contained in the lower chamber 26 is increased, absorption characteristic of the floating carrier by the magnet 32 is not lost. This is because the magnet 32 is not covered by the waste developer accumulated on the bottom of the lower chamber 26. That is, it is preferable that the magnet 32 be at a high position rather than at a low position. This is because it is less likely to be covered by the accumulated waste developer.

Specifically, the position of the magnet 32 higher than the position of incidence/emission of the light L has a following meaning. That is, absorption characteristic of the magnet 32 is maintained until full is actually detected. The absorption characteristic of the magnet 32 is required until the position of incidence/emission is covered by the accumulated waste developer. Once the position of incidence/emission is covered by the waste developer, full is actually detected and it has nothing to do thereafter.

In addition, the position of the magnet 32 higher than the position of the delivery screw 28 has a following meaning. That is, delivery of the waste developer in the lower chamber 26 by the delivery screw 28 causes part of the accumulated waste developer to fly and may become a cause of production of floating waste developer. Of course, such floating waste developer floats above the delivery screw 28. Therefore, with the magnet 32 being higher than the delivery screw 28, produced floating carrier can be efficiently attracted. Note that, the position of the magnet 32 higher than the position of the delivery screw 28 means that, the position of the magnet 32 needs to be at least higher than the lowest position in the delivery screw 28. It is more preferable that the position of the magnet 32 be higher than the center of the delivery screw 28. Moreover, it is much more preferable that the position of the magnet 32 be much higher than the highest position in the delivery screw 28.

In addition, according to the embodiment of the present invention, the magnet 32 is provided to face the container space of the lower chamber 26. Therefore, of course, it is advantageous in terms of absorption characteristic of the magnet 32. This is because the magnetic force of the magnet 32 is directly applied to the container space without a wall member of the waste developer container 17. However, even if the magnet 32 is located outside via the wall member of the waste developer container 17 as viewed from the lower chamber 26, it is acceptable as long as sufficient magnetic force can be applied to the space near the detection window 29. Note that, it is needless to say that the magnet 32 should not be provided at the position where it interrupts the light path of the light L.

Next, material of the detection window 29 will be described. Before that, as to material of the entire waste developer container 17, synthetic resin is often used in terms of requirement of reduction in weight. Type of synthetic resin is not particularly limited in the present invention. Then, as for material of the detection window 29, any material is acceptable as long as it is transparent. It may be glass. However, transparent synthetic resin is often practically used together with the material of the entire waste developer container 17. A typical example is polystyrene.

However, since polystyrene has rather minus characteristic on triboelectric series of various substances, it tends to be charged with minus static electricity. Then, since the surface resistance is as high as $10^{17}\Omega$, it hardly discharges once charged. On the other hand, two-component developer used for a two-component developing device such as developing device 7 in the embodiment of the present invention is generally used with the carrier being frictionally charged in plus and toner being frictionally charged in minus.

The charging state of the developer in the developing device 7 is almost kept even when it becomes waste developer and is contained in the lower chamber 26. Therefore, it is likely that the floating carrier in the lower chamber 26 is also charged in plus. Floating carrier easily adheres to the detection window 29 if there is no magnet 32. In that respect, the significance of the magnet 32 is large. In addition, as described above, in the embodiment of the present invention, the extent of charging of the carrier in the developing device 7 is set stronger than normal. This means that plus charging of the floating carrier in the lower chamber 26 is also stronger than normal devices. In addition, in that respect, the significance of attraction of the floating carrier by the magnet 32 is large. Note that, from the above description, it is likely that floating toner is charged in minus in contrast. This is also a reason that adhesion of floating toner to the detection window 29 is not a big problem.

The above description is true for not only a case in which polystyrene is used as a material of the detection window 29 but also a case in which other kind of transparent resin on the minus side with respect to polystyrene on triboelectric series is used. However, "transparent" used herein means transparent against the light L used in the waste developer amount detection unit 23. It is not necessarily transparent against visible light if light other than visible light is used as the light L.

Figure 9:
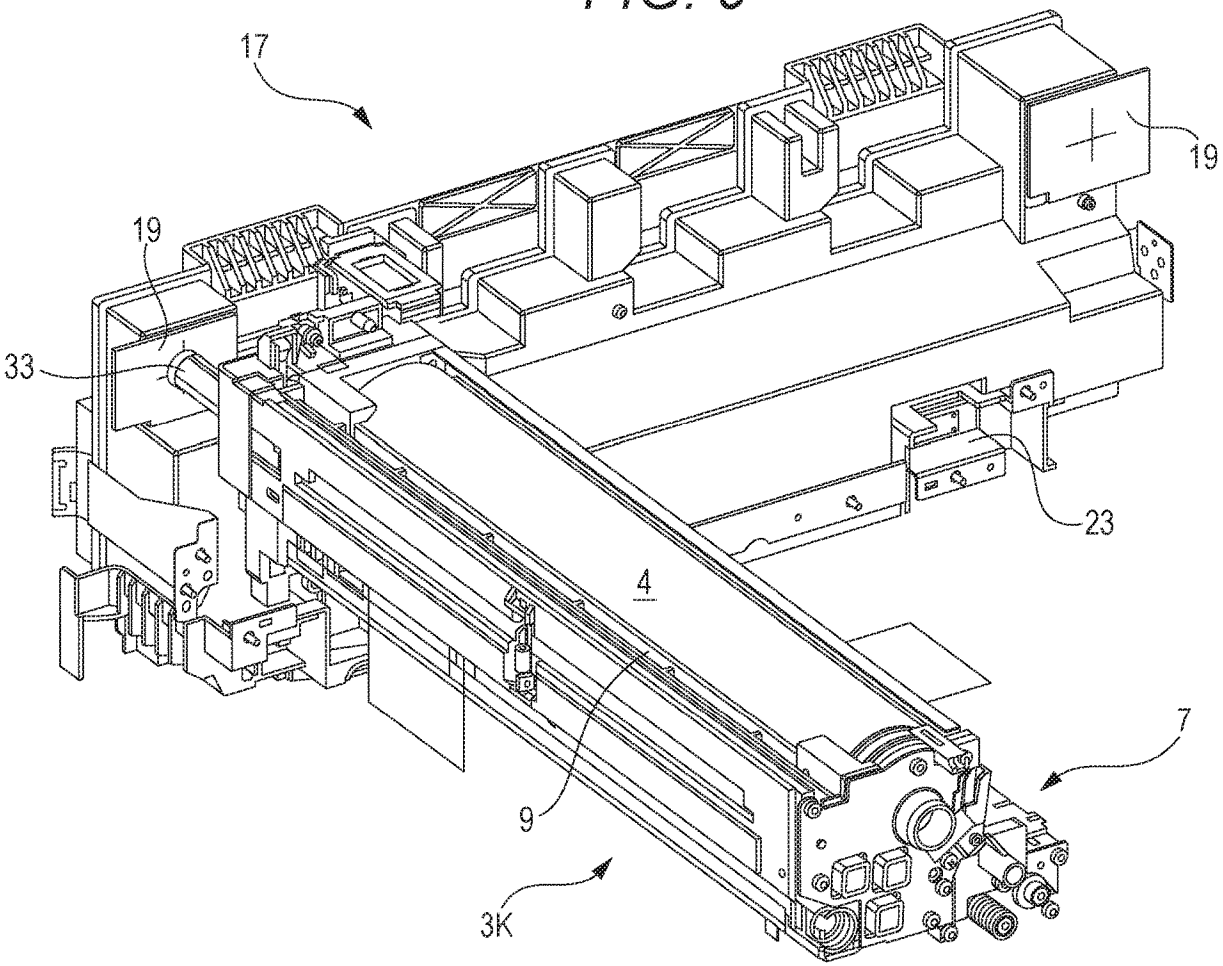
FIG. 9 is a perspective view illustrating relationship of the waste developer container and an image forming unit according to the embodiment.

Next, relationship between the waste developer container 17 and other members in fixed state will be described. FIG. 9 illustrates relationship between the waste developer container 17 and the image forming unit 3K. In the fixed state illustrated in FIG. 9, the photoreceptor 4 is located little lower than the upper end of the waste developer container 17. FIG. 9 is a perspective view illustrating the waste developer container 17 and the image forming unit 3K viewed from the rear side of the image forming device 1. Therefore, the image forming units 3Y to 3C located to the left of the image forming unit 3K in FIG. 1 are arranged in series to the right of the image forming unit 3K if illustrated in FIG. 9. However, in FIG. 9, the image forming units 3Y to 3C are omitted. In addition, although the rotation direction of the photoreceptor 4 is clockwise in FIG. 1, it is anticlockwise in FIG. 9. Therefore, in FIG. 9, the photoreceptor cleaner 9 is located to the left of the photoreceptor 4 and the developing device 7 is located to the right of the photoreceptor 4.

As illustrated in FIG. 9, a waste toner nozzle 33 is provided to the image forming unit 3K. The waste toner nozzle 33 projects toward the waste developer container 17, and its end enters inside of the waste developer container 17 through the left cross-cut part 19 in FIG. 9. Accordingly, the waste toner collected by the photoreceptor cleaner 9 of the image forming unit 3K is contained in the upper chamber 25 of the waste developer container 17 via the waste toner nozzle 33.

Note that, the waste developer produced in the developing device 7 of the image forming unit 3K is contained in the lower chamber 26 of the waste developer container 17 as described with reference to FIG. 2. However, the locations of the waste developer discharge unit 22 and the waste developer acceptance inlet 20 are not shown in FIG. 9 because they are behind the image forming unit 3K. Note that, in FIG. 9, the surrounding of the waste developer amount detection unit 23 that forms the main unit of the image forming device 1 is illustrated on the location of the projection part 21 of the waste developer container 17. Therefore, the projection part 21 is not shown in FIG. 9.

Figure 10:
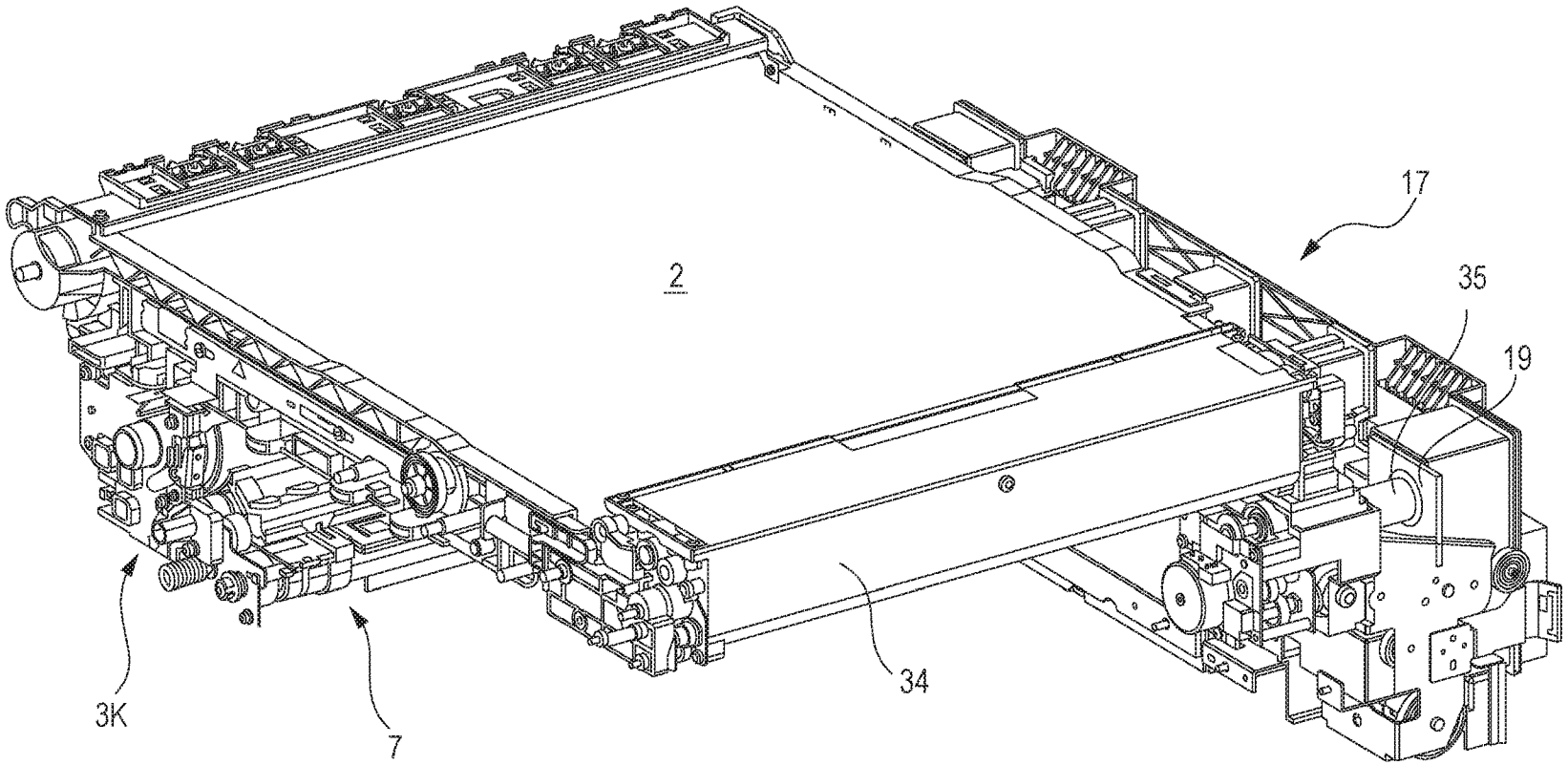
FIG. 10 is a perspective view illustrating relationship of the waste developer container and an intermediate transfer belt according to the embodiment.

Next, FIG. 10 illustrates relationship between the waste developer container 17 and the intermediate transfer belt 2. In the fixed state as illustrated in FIG. 10, the intermediate transfer belt 2 is located to protrude a bit from the upper end of the waste developer container 17. FIG. 10 is the same as FIG. 9 in that it is a perspective view illustrating the object viewed from the rear side of the image forming device 1. However, they are different in that the line of sight in FIG. 9 is from right rear while that in FIG. 10 is from left rear (right-left is right-left in FIG. 2). Note that, although the image forming unit 3K is illustrated also in FIG. 10, most parts of it are behind the intermediate transfer belt 2 and only a few parts is shown.

As illustrated in FIG. 10, the end of the intermediate transfer belt 2 in the front middle of FIG. 10 is covered by a cover member 34. What is covered by the cover member 34 is the left end of the intermediate transfer belt 2 in FIG. 1. Therefore, the belt cleaner 13 is hidden behind the cover member 34. The cover member 34 itself is one of components that form the chassis 15. As illustrated in FIG. 10, a waste toner nozzle 35 is provided to project forward with respect to the front end of the cover member 34 (right end in FIG. 10). The end of the waste toner nozzle 35 enters inside of the waste developer container 17 through the right cross-cut part 19 in FIG. 10. Accordingly, the waste toner collected by the belt cleaner 13 from the intermediate transfer belt 2 is contained in the upper chamber 25 of the waste developer container 17 via the waste toner nozzle 35.

Note that, although the image forming units 3Y to 3C are omitted also in FIGS. 9 and 10, handling of waste toner and waste developer produced therefrom will be as follows. First, the waste toner collected by the photoreceptor cleaner 9 of the image forming units 3Y to 3C goes to one of the waste toner nozzles 33 and 35 described above to be contained in the upper chamber 25 of the waste developer container 17. The waste developer produced in the developing device 7 of the image forming units 3Y to 3C is also thrown into the waste developer acceptance inlet 20 of the waste developer discharge unit 22 as with the waste developer produced in the developing device 7 of the image forming unit 3K.

As described above in detail, according to the present embodiment, the magnet 32 is provided near the detection window 29 of the lower chamber 26 of the waste developer container 17. Accordingly, waste carrier floating near the detection window 29 of the inner space of the lower chamber 26 is attracted to the magnet 32 so that adhesion to the detection window 29 is prevented. By this means, interruption of detection of full of the lower chamber 26 by adhesion of floating waste carrier is prevented and correct full detection is secured. Accordingly, the waste developer container 17 that effectively uses the capacity of the lower chamber 26 and the image forming device 1 with such waste developer container are realized. Specifically, waste carrier is appropriately attracted by the magnet 32 by locating the magnet 32 near the upper end of the lower chamber 26.

Note that, the present embodiment is merely an example and does not limit the present invention in any way. Therefore, various improvements and modifications are possible without departing from the spirit of the present invention. For example, the magnet 32 may be provided outside the lower chamber 26 as described above and the magnet 32 may be provided to the main unit side of the image forming device 1. In addition, a reflecting mirror may be provided inside the projection part 21 and the light L from the light emitting part 30 may be reflected by the reflecting mirror and received by the light receiving part 31. In this case, there may be only one detection window 29.

In addition, the present invention may be applied to a waste developer container in which the upper chamber 25 and the lower chamber 26 are not divided by the partition wall 24 and waste developer and waste toner are contained in container space together. Alternatively, the present invention may be applied to a container of waste developer in which a container of waste developer and a container of waste toner are completely separate. In addition, any of such containers is not necessarily detachable from the main unit of the image forming device 1. It may be fixed type. Moreover, configuration of the image forming device 1 is not limited to tandem color type described above but may be multi-cycle color type or monochromic type. Moreover, it may be a copying machine with a scanner function or may be one that can communicate with an external line.

According to an embodiment of the present invention, with this configuration, an image forming device that develops an image by a trickle developing method with two-component developer and successfully detects the amount contained in a waste developer container is provided. In addition, a waste developer container suitable for such an image forming device is provided.

Although the present invention has been described and illustrated in detail, it is clearly understood that the same is by way of illustrated and example only and is not to be taken by way of limitation, the scope of the present invention being interpreted by terms of the appended claims.

What is claimed is:

1. A waste developer container to be fixed to an image forming device including a developing device and a waste developer amount detection unit for obtaining information on an amount of accumulated waste developer discharged from the developing device, wherein the developing device is a developing device that uses toner image carrier holding a toner image and two-component developer including toner and carrier to form a toner image held on the toner image carrier by a trickle developing method, the waste developer amount detection unit obtains the information on the accumulated amount by emission and reception of light, and the waste developer container comprises:

a container space for containing waste developer discharged from the developing device;

a detection window for passing light that is emitted from the waste developer amount detection unit, passes the container space, and is incident again to the waste developer amount detection unit; and a magnet provided to a position where a magnetic force is applied to the detection window and that does not obstruct a line of sight of the light sensor.

2. The waste developer container according to claim 1, wherein the magnet faces the container space.

3. The waste developer container according to claim 1, wherein the magnet is provided at a position that is upper in a direction of a gravitational force than the location where light that is incident from the waste developer amount detection unit in the detection window and light emitted to the waste developer amount detection unit pass.

4. The waste developer container according to claim 1, further comprising a carrying member for carrying waste developer contained in the container space in the container space, wherein the magnet is provided to a position that is upper than the carrying member in a direction of a gravitational force.

5. The waste developer container according to claim 4, further comprising a partition wall for dividing the container space into a waste developer container space for containing waste developer discharged from the developing device and a waste toner container space for containing waste toner collected from the toner image carrier, wherein the carrying member is provided in the waste developer container space, and the detection window is a part of an outer wall that separates the waste developer container space from outside.

6. The waste developer container according to claim 1, wherein the detection window is made of polystyrene or synthetic resin that is on a negatively charged side on a triboelectric series with respect to polystyrene.

7. An image forming device comprising:

a toner image carrier for holding a toner image;

a developing device that uses two-component developer including toner and carrier to form a toner image held on the toner image carrier by a trickle developing method;

a waste developer container including a container space for containing waste developer discharged from the developing device;

a waste developer amount detection unit provided outside the waste developer container for obtaining information on an amount of waste developer contained in the waste developer container by receiving light that is emitted to the waste developer container, passes the container space, and is emitted from the waste developer container;

a detection window provided as a part of the waste developer container for passing the light between the waste developer amount detection unit and the container space; and a magnet provided to a position where a magnetic force is applied to the detection window and that does not obstruct a line of sight of the light sensor.

8. The image forming device according to claim 7, wherein the developing device develops an image with an amount of charging of the carrier being a range between 40 and 60 μC/g.

9. The image forming device according to claim 7, wherein the magnet faces the container space.

10. The image forming device according to claim 7, wherein the magnet is provided at a position that is upper in a direction of a gravitational force than the location where light that is incident from the waste developer amount detection unit in the detection window and light emitted to the waste developer amount detection unit pass.

11. The image forming device according to claim 7, further comprising a carrying member for carrying waste developer contained in the container space in the container space, wherein the magnet is provided to a position that is upper than the carrying member in a direction of a gravitational force.

12. The image forming device according to claim 11, further comprising a partition wall for dividing the container space into a waste developer container space for containing waste developer discharged from the developing device and a waste toner container space for containing waste toner collected from the toner image carrier, wherein the carrying member is provided in the waste developer container space, and the detection window is a part of an outer wall that separates the waste developer container space from outside.

13. The image forming device according to claim 7, wherein the detection window is made of polystyrene or synthetic resin that is on a negatively charged side on a triboelectric series with respect to polystyrene.

* * * * *